United States Patent [19]

Abbott

[11] Patent Number: 4,616,780

[45] Date of Patent: Oct. 14, 1986

[54] POP-UP SPRINKLER

[76] Inventor: Eion A. Abbott, 7 Mais Street, Brompton, Australia

[21] Appl. No.: 613,505

[22] Filed: May 23, 1984

[30] Foreign Application Priority Data

May 24, 1983 [AU] Australia ..... PF9510

[51] Int. Cl.[4] ..... B05B 15/02; B05B 15/10

[52] U.S. Cl. ..... 239/113; 239/205

[58] Field of Search ..... 239/203–206, 239/106, 112, 113

[56] References Cited

U.S. PATENT DOCUMENTS

| | | | |
|---|---|---|---|
| 1,800,858 | 4/1931 | Buelna | 239/205 |
| 1,938,511 | 12/1933 | Brady | 239/204 |
| 1,999,470 | 4/1935 | Munz | 239/204 X |
| 3,104,822 | 9/1963 | Muschett | 239/206 |
| 3,301,489 | 1/1967 | Tropeano et al. | 239/204 |
| 3,503,555 | 3/1970 | Lockwood et al. | 239/204 |

*Primary Examiner*—Joseph F. Peters, Jr.

*Assistant Examiner*—Patrick N. Burkhart

*Attorney, Agent, or Firm*—Brown, Martin, Haller & Meador

[57] ABSTRACT

A pop-up sprinkler having a sprinkler head which is arranged in response to pressure water flowing therethrough to automatically elevate to a position above the ground for watering purposes and to lower itself to a position below the ground surface when the water pressure is removed, the sprinkler head being supported on a vertical movable riser tube slidably located within a tubular housing, the arrangement being such that during the ascent and descent of the riser tube, water flows across the outer surface of the riser tube and the inner surface of the stem to thereby flush same. Descent of the riser tube is aided by means of a spring having hooks at its upper and lower ends, with the upper hook attached to a legged spring clip abutting a shoulder on the riser tube, and the lower hook attached to a retention pin traversing the housing stem.

8 Claims, 2 Drawing Figures

POP-UP SPRINKLER

Figure 1:
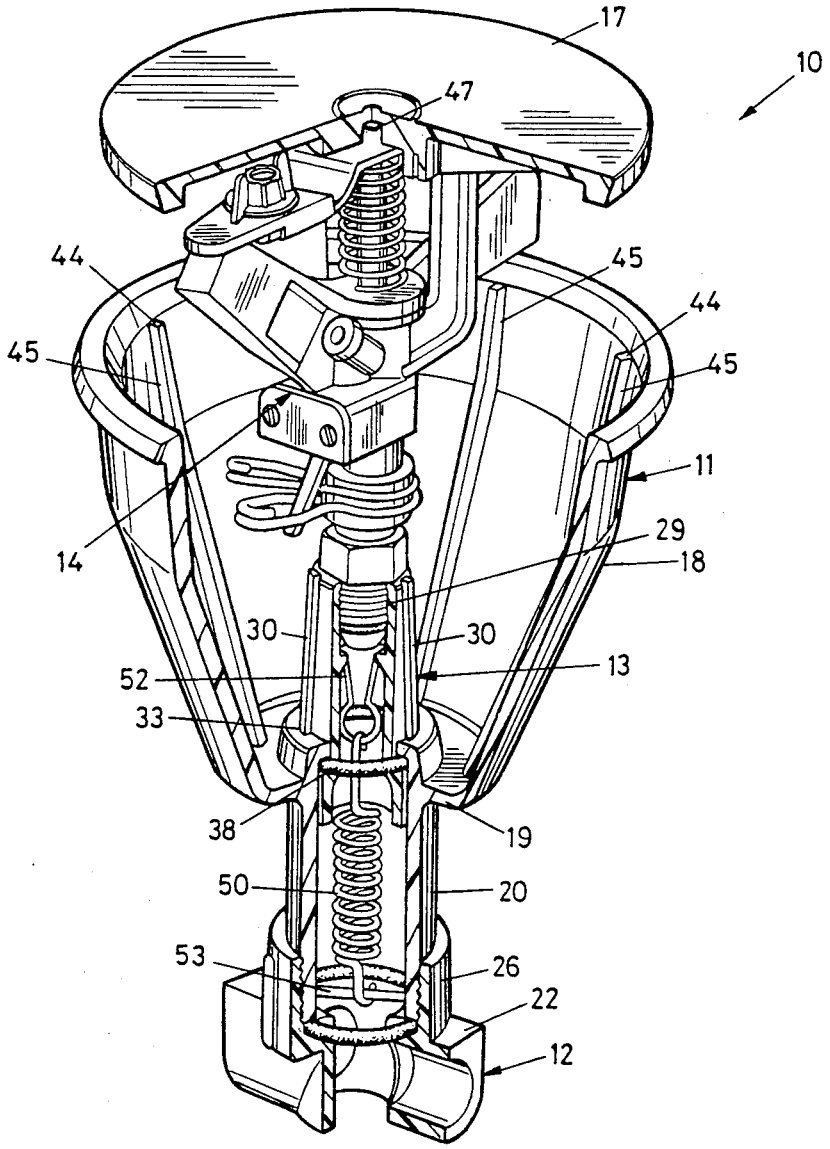

This invention relates to water sprinklers, and in particular to sprinklers of the type known as "pop-up" sprinklers, that is sprinklers which are adapted to project upwardly above the ground or lawn surface when in use and to retract to a position below the ground or lawn surface when the water pressure is turned off, the sprinkler in the retracted position being thus protected from damage by traffic over the ground or lawn.

It is known to produce pop-up water sprinklers having a sprinkler head which is arranged, in response to pressure water flowing therethrough, to automatically elevate to a position above the ground for watering purposes and to lower itself gravitationally to a position below the ground surface when the water pressure is removed. However, a number of the problems exist with prior art pop-up sprinkler systems. Firstly, of those known to the applicants, their design is relatively complex as a consequence of which they are not able to be manufactured easily and economically. Secondly, they are susceptible to "clogging" caused by foreign matter such as dirt and grit which finds its way into the sprinkler mechanism by entrainment with the water flowing therethrough or by entering the sprinkler housing through its open end. When "clogging" occurs, the pop-up mechanism is most likely to malfunction (particularly when the sprinkler system has been inoperative for any length of time) thus necessitating the removal and cleaning of the "jammed" sprinkler units from their below-ground housing. Thirdly, existing pop-up sprinkler systems have generally proven difficult to install as well as service.

It is the main object of the present invention to provide an improved lawn sprinkler of the pop-up type which will operate efficiently, is of simple design and which is less susceptible to clogging by foreign matter or debris in comparison to prior art units.

It is a further object of the present invention to provide a lawn sprinkler of the abovementioned type which can be manufactured and installed both easily and economically.

Accordingly this invention is directed to an improved pop-up sprinkler of the type comprising:

- a housing having walls defining a sprinkler head housing cavity and a tubular stem depending from said cavity, the lower end of said stem being adapted for connection to an underground water supply pipe, and,
- a sprinkler head support means for supporting a sprinkler head on top thereof, said support means being movable between a retracted out-of-use position and an extended in-use water sprinkling position in response to the removal and establishment of water pressure respectively,
- characterised by an open ended riser tube constituting said support means, slidably located for vertical up and down movement within said tubular stem, there being a water flushing flow path which fluidly interconnects the stem and said cavity and wherein water flows across the outer surface of said riser tube and the inner surface of said stem and also characterised by co-operable sealing means and sealing engagement means between said riser tube and said tubular stem, arranged to seal off said water flushing flow path when said riser tube is in its extended in-use water sprinkling position but permitting water flow along said water flushing flow path during said up and down movement of said riser tube the water flow along said water flushing flow path being effective to flush the surfaces of said riser tube and said stem which are in sliding contact and the space between said stem and said riser tube.

In a preferred arrangement, the casing and the centrally depending stem comprise an integrally moulded body of synthetics plastics material, for example polypropylene, the skirt of the casing having an approximately inverted frusto-conical shape.

In a further preferred arrangement, the riser tube is provided with bias means urging said tube, together with its supported sprinkler head unit, towards its retracted out-of-use position. The use of a bias spring would normally be needed with small light-weight units where the weight of the sprinkler head and its associated riser tube might be insufficient to cause the retraction of the sprinkler to its out-of-use position by gravity alone once water pressure has been turned off.

In a further preferred arrangement, the sealing means comprises a sealing O-ring located in an annular groove extending around the riser tube adjacent its lower end.

A significant advantage of the present invention resides in the fact that the pop-up sprinkler design essentially contains one moving part only, namely the vertically movable riser tube (it being appreciated that the rotatable sprinkler head supported on top of the riser tube forms no part of this invention).

Figure 2:
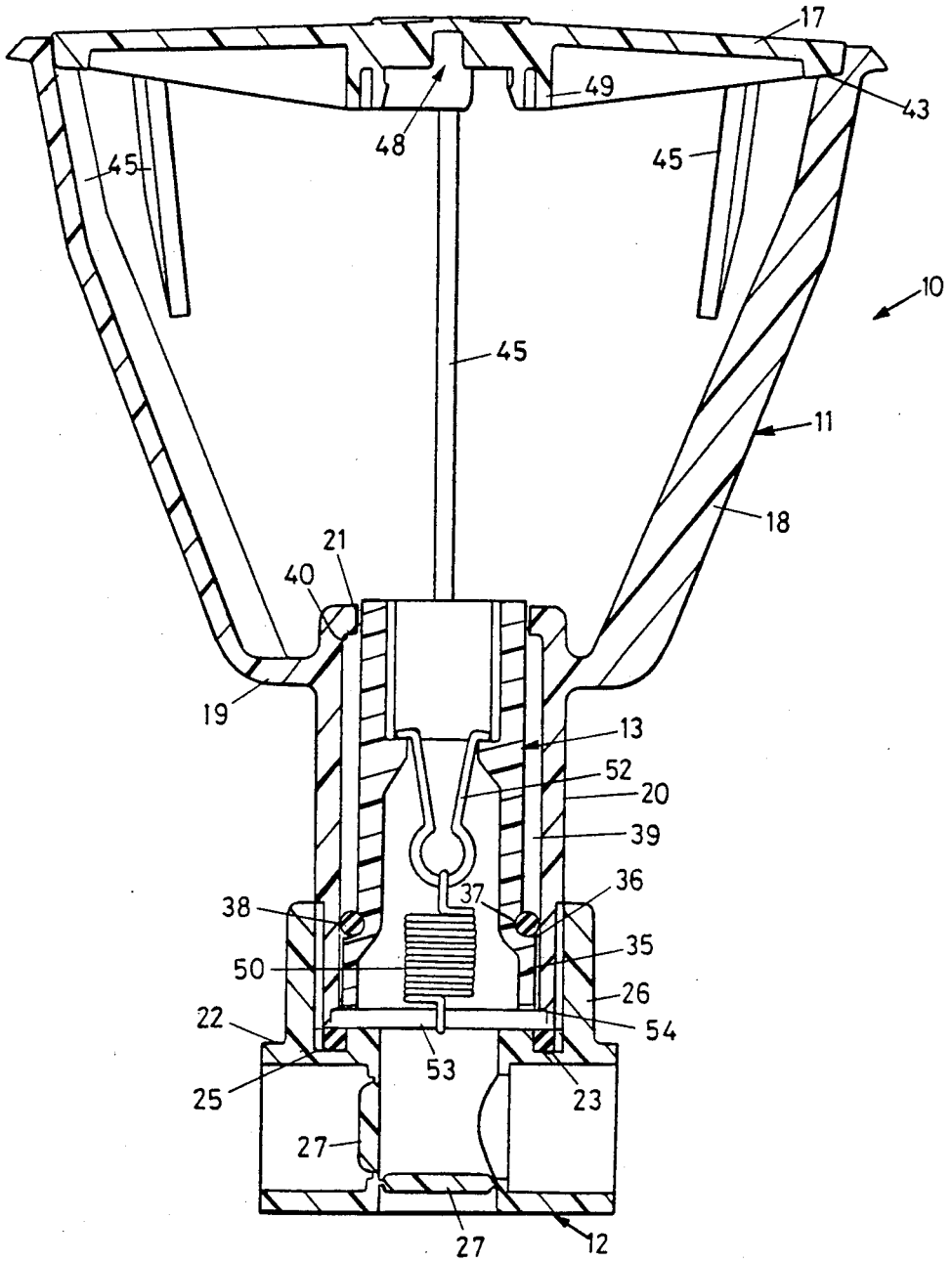

Further advantages of the invention will appear during the course of the following description wherein details of construction and mode of operation of a preferred embodiment of the invention are described with reference to the accompanying drawings in which:

FIG. 1 is a partly sectioned, perspective view of a sprinkler according to a preferred embodiment of this invention (showing the sprinkler head in its elevated in-use watering position), and FIG. 2 is a vertical sectional view taken through the sprinkler (but omitting the sprinkler head for the sake of clarity).

In this embodiment, a pop-up water sprinkler 10 comprises a hollow open-ended casing or housing 11 adapted to be installed below the surface of the ground or lawn, a connector fitting 12 connectable to the lower end of the housing 11 and itself being adapted for connection to an underground water supply pipe (not shown), a freely movable riser tube 13 guided for vertical movement within housing 11, a conventional sprinkler head unit 14 of the oscillating type mounted on top of the riser tube 13, and a closure cap or lid 17 releasably fitted on top of the sprinkler head 14 and arranged to close off the open upper end of the housing 11 when the sprinkler is not required for watering purposes. In this embodiment, the housing 11, connector fitting 12, riser tube 13 and closure cap 17 are all injection moulded members of polypropylene material for premium weathering and impact resistance.

The housing 11 is formed with an inverted cup-shaped skirt 18 which tapers downwardly and has an out-turned annular flange extending around its upper periphery, the lower end of the skirt 18 terminating in an inwardly turned horizontal annular flange or ledge 19 which itself connects to a central axial tubular stem or leg 20 the stem 20 projecting downwardly from the flange 19. The inturned flange 19 can be provided with circumferentially spaced water drainage apertures (not shown) to allow water which has collected in the bottom of the housing 11 to drain therethrough. The lower end of the central stem 20 is threaded for connection to water supply pipe connector 12 whilst its upper end projects slightly into the interior of the skirt 18 and terminates in an inwardly turned annular lip 21 which defines a circular opening which comprises the upper open end of the stem, the diameter of which is less than the internal diameter of the central tubular stem 20.

The connector fitting 12 is threadably engaged onto the threaded lower end of the depending central stem 20, the connector fitting 12 in this embodiment being an inverted T-piece with one of the horizontal limbs 22 being adapted to be connected in line to an underground water supply pipe (not shown). A rubber O-ring 23 is located in an annular groove 25 formed in the base of the vertical limb 26 of the inverted T-piece fitting 12, the O-ring being arranged to seal against the circular end face of the central stem 20 when the stem 20 is screw-threaded into the internally threaded vertical limb 26. In this embodiment, the connector member 12 is formed with two removable circular closure portions 27 which can be selectively broken depending upon whether the water supply pipe is to be connected to the bottom of the connector member 12 or to one of its side inlet limbs 22.

The vertically movable riser tube 13 is guided for vertical up and down movement within the stem 20, the upper end of the riser tube 13 being internally threaded for receiving a threaded nipple 29 which connects to and secures the sprinkler head unit 14 to the riser tube 13. The outer cylindrical surface of the riser tube 13 is provided with axially extending ribs 30 which engage in cut-outs or grooves 33 spaced around the periphery or free edge of the inturned annular lip or seat 21 for guiding the riser tube 13 during its vertical up and down movement.

The lower end of the riser tube 13 is formed with a large diameter section 35, the outer diameter of which is slightly less than the inner diameter of the central stem 20. The large diameter section 35 forms an upward facing annular shoulder 36 on the outside of the riser tube 13, the shoulder 36 together with an annular groove 37 adjoining the shoulder 36 serving to locate an O-ring seal 38 near to the lower end of the riser tube. The O-ring seal 38 thus moves vertically upwards and downwards along with the riser tube 13 in the annular chamber or space 39 between the outer surface of the riser tube 13 and the inner surface of the stem 20. The outer diameter of the O-ring 38 is larger than the size of the circular opening defined by the lip 21 at the upper end of the central stem 20. This arrangement serves a two-fold purpose, firstly, to limit the extent of upward travel of the riser tube 13 and secondly, to prevent water passing out through the gap between the inturned lip 21 and the outside of the riser tube 13, once the riser tube 13 has reached its uppermost or extended in-use position. Once the O-ring 38 sealably engages against the radially inwardly directed annular seat 40 defined by the lip 21 at the open upper end of the depending stem 20, water is permitted to flow only through the interior of the tube 13 for discharge through the sprinkler head 14.

In this embodiment, the open upper end of the housing 11 is closed off by means of the circular closure cap or lid 17 which is designed to seat itself flushly on a ledge 43 located on the inner surface of the skirt 18 adjacent its upper end, the ledge 43 being formed by the upper end faces 44 of a series of axially extending strengthening ribs 45 formed integrally on the inner surface of the housing skirt 18.

The closure cap 17 is releasably clipped to the sprinkler head 14, whereby it moves in unison with the up and down movement of the sprinkler head 14. The clip means in this embodiment comprises a short upstanding pin 47 located centrally on the sprinkler head 14 which is arranged to frictionally fit into a centrally located downwardly opening socket 48 on the underside of the lid 17. The underside of the cap or lid 17 also comprises a depending annular boss 49 which is arranged to locate over a complementary shaped portion on the sprinkler head 14.

In operation, when water pressure is turned on, water flows through the inlet connector 12 and into the interior of the riser tube to cause the riser tube 13 to elevate. At the same time, some of the incoming water flows through the annular chamber 39 between the outer surface of the riser tube 13 and the inner surface of the stem 20 and escapes through the gap or opening between the inner peripheral walls of the inturned lip 21 and the outer surface of the riser tube 13. In this manner, the chamber defining surfaces of the riser tube and stem as well as the surfaces which are in sliding contact are flushed with pressure water. The riser tube 13 rises until the O-ring seal 38 abuts or engages against the seat 40 formed by the lip 21 at the upper end of the chamber 39 whereby an effective seal is created between the riser tube 13 and the seat 40 to thereby shut off the flow of water being flushed through the annular chamber 39. Water under full pressure then flows through the interior of the riser tube 13 into the elevated sprinkler head unit 14 which is now at its extended or elevated in-use watering position.

Of course, upon elevation of the riser tube 13 and sprinkler head 14 mounted thereon, the closure lid 17 is also elevated and the gap formed between the open upper end of the housing 11 and the lid 17 enables jet streams of water to pass therebetween and sprayed onto adjacent ground or lawn areas.

When the water to the sprinkler system is turned off, the removal of water pressure "breaks" the seal between the riser tube 13 and the seal 40 on the stem 20, and the sprinkler 14, together with the riser tube 13 descends or retracts to a position whereat the riser tube 13 is almost fully housed within the stem 20 (refer FIG. 2). When the seal 38 moves away from its seat 40 again water will, for a short period of time, flow through passage between the stem and the riser tube and into the housing cavity to thereby flush out once again any grit or dirt which collected in the chamber 39. Thus flushing of the chamber 39 is effected during both up and down movement of the riser tube 13.

The descending movement of the sprinkler unit can be effected solely by gravitational forces, but preferably a tension spring 50 is incorporated to assist the return movement of the riser tube 13 and its associated sprinkler head 14. In one preferred arrangement, the spring 50 is located internally of the riser tube 13 and has hook formations at its opposite upper and lower ends, with one end coupled to a retaining spring clip 52 anchored to the riser tube 13 and its other lower end hooked over a fixed cross-pin 53 located at the base or lower end of the stem 20, the cross-pin 53 being of length greater than the outside diameter of the riser tube and having its ends engaged in metrically opposed cut-outs 54 in the inner surface of the stem 20. Preferably, the spring 50, clip 52 and pin 53 are all made of stainless steel.

It will be appreciated of course that the invention may be varied in a number of ways from that described hereinabove. For example, instead of having the O-ring seal 38 located on the riser tube 13, it could be located at the upper end of the stem 20. In this instance, the seal is created through engagement of the O-ring and the annular shoulder 36 adjacent the lower end of the riser tube 13.

A brief consideration of the above embodiment will indicate that the invention provides for a very simple and efficient pop-up sprinkler unit having essentially one only moving part (the riser tube), one which can be manufactured easily and economically, and one which, in comparison to prior art units, is less likely to suffer problems arising from the build-up of foreign matter within the unit, whether such foreign matter be entrained in the water flowing therethrough or work its way into the open end of the housing of the sprinkler unit.

I claim:

1. An improved pop-up sprinkler of the type comprising:

a housing having walls defining a sprinkler head housing cavity and a tubular stem depending from said cavity the lower end of said stem being adapted for connection to an underground water supply pipe, a sprinkler head support means for supporting a sprinkler head on top thereof, said support means being movable between a retracted out-of-use position and an extended in-use water sprinkling position in response to the removal and establishment of water pressure respectively, characterized by an open ended riser tube constituting said support means, slidably located for vertical up and down movement within said tubular stem, there being a water flushing flow path which fluidly interconnects the stem and said cavity and wherein water flows across the outer surface of said riser tube and the inner surface of said stem, there being cooperable sealing means and sealing engagement means between said riser tube and said tubular stem, arranged to seal off said water flushing flow path when said riser tube is in its extended in-use water sprinkling position, but permitting water flow along said water flow path during said up or down movement of said riser tube the water flow along said first water flushing flow path being effective to flush the surfaces of said riser tube and said stem which are in sliding contact and the space between said stem and said riser tube, and further characterized by a spring assembly operatively connected between said riser tube and said stem for returning said tube to its retracted out-of-use position when the water pressure is removed, said spring assembly comprising a tension spring which, when the tube is in its out-of-use position, is housed interiorly of the riser tube, upper spring end retention means within the riser tube intermediate its ends for releasably retaining the upper end of the spring, and lower spring end retention means adjacent the lower end of said stem and secured with respect thereto for releasably retaining the lower end of said spring, said tension spring terminating at its upper and lower ends in hook formations, said upper spring end retention means comprising spring clip means removably insertable within said riser tube and having a loop portion at its lower end to which is releasably hooked said upper hook formation of the tension spring, said riser tube having respective inwardly projecting shoulders formed interiorly of the riser tube, said spring clip means having out-turned leg portions for abutting engagement with said inwardly projecting shoulders and wherein said lower spring end retention means comprises a transverse retention pin having a length greater than the outside diameter of the riser tube, the inner surface of the stem having diametrically opposed recesses at its lower end and the retention pin having projecting ends for engagement in the opposed recesses of the stem.

2. An improved pop-up sprinkler according to claim 1 wherein said riser tube, when in its elevated in-use water sprinkler position, extends for a major portion of its length, upwardly beyond the upper open end of said depending stem, whilst when in its retracted out-of-use position, substantially the whole of the riser tube is hosed within the bore of said stem.

3. An improved pop-up sprinkler according to claim 1 wherein said sealing means comprises a sealing O-ring located in an annular groove extending around said riser tube near to or adjacent its lower end, and wherein said sealing engagement means comprises a radially inwardly directed annular seat located at the upper end of said stem.

4. An improved pop-up sprinkler according to claim 3, werein said housing is provided with a closure plate removably mounted on top of said sprinkler head and adapted to sit flushly over the open upper end of said housing when said riser tube is in its retracted out-of-use position.

5. An improved pop-up sprinkler according to claim 3 wherein said riser tube comprises a series of circumferentially spaced axially extending guide ribs on its outer cylindrical surface which slidably engage in grooves spaced around the free edge of said annular seat, said ribs and said grooves constituting guide means for guiding the riser tube during its vertical up and down movement.

6. An improved pop-up sprinkler according to claim 5 wherein said housing is cup-shaped and has side walls which converge in a downwards direction, and an out-turned annular flange extending around the periphery of said housing.

7. An improved pop-up sprinkler according to claim 3 wherein said housing, said riser tube and said connector are all moulded from thermoplastics material.

8. An improved pop-up sprinkler according to claim 1 further comprising an inverted T-piece connector fitting arranged to threadably engage the lower end of said depending stem, said connector fitting in turn being connectable in line to an underground water supply pipe.

* * * * *